US009358177B1

(12) United States Patent
Hoogenboom

(10) Patent No.: US 9,358,177 B1
(45) Date of Patent: Jun. 7, 2016

(54) MEDICAL CRUTCH

(71) Applicant: Jeffrey Alan Hoogenboom, Moretown, VT (US)

(72) Inventor: Jeffrey Alan Hoogenboom, Moretown, VT (US)

( * ) Notice: Subject to any disclaimer, the term of this patent is extended or adjusted under 35 U.S.C. 154(b) by 0 days.

(21) Appl. No.: 13/965,097

(22) Filed: Aug. 12, 2013

Related U.S. Application Data

(60) Provisional application No. 61/681,689, filed on Aug. 10, 2012.

(51) Int. Cl.
*A61H 3/02* (2006.01)

(52) U.S. Cl.
CPC ..... *A61H 3/0277* (2013.01); *A61H 3/0288* (2013.01)

(58) Field of Classification Search
CPC ..... A61H 3/02; A61H 2/0277; A61H 3/0288
USPC ..... 135/68, 69, 82
See application file for complete search history.

(56) References Cited

U.S. PATENT DOCUMENTS

| | | | | | |
|---|---|---|---|---|---|
| 1,183,008 | A | | 5/1916 | Hipwood | |
| 1,296,728 | A | * | 3/1919 | Yates | 135/72 |
| 1,336,844 | A | * | 4/1920 | Klousnitzer | 135/82 |
| 1,438,883 | A | | 12/1922 | Youngren | |
| 1,652,110 | A | * | 12/1927 | Fullington | 135/69 |
| 1,909,337 | A | | 5/1933 | Crosbie | |
| 2,365,730 | A | * | 12/1944 | Seyfferle | 135/69 |
| 2,397,499 | A | * | 4/1946 | McGowan | 135/82 |
| 2,426,074 | A | * | 8/1947 | Watters | 135/69 |
| 2,478,667 | A | | 8/1949 | Shellhouse et al. | |
| 2,568,654 | A | * | 9/1951 | Neptune | 135/69 |
| 2,670,748 | A | * | 3/1954 | Greene et al. | 135/69 |
| 2,856,943 | A | * | 10/1958 | Sparlin | 135/68 |
| 2,888,022 | A | * | 5/1959 | Fanning | 135/82 |
| 3,301,268 | A | * | 1/1967 | Tryon | 135/69 |
| 3,335,735 | A | * | 8/1967 | Colegrove et al. | 135/69 |
| 3,486,515 | A | | 12/1969 | Chrysostomides | |
| 4,237,916 | A | * | 12/1980 | Harrison-Smith et al. | 135/69 |
| 5,628,335 | A | * | 5/1997 | Free | 135/68 |
| 6,055,998 | A | * | 5/2000 | Bader | 135/69 |
| 6,286,529 | B1 | * | 9/2001 | Olivera | 135/82 |
| 7,347,215 | B1 | | 3/2008 | Birnbaum | |
| 7,395,829 | B2 | * | 7/2008 | Chapman | 135/82 |
| 7,481,233 | B2 | * | 1/2009 | Park | 135/82 |
| 7,712,478 | B2 | * | 5/2010 | Gibbons et al. | 135/73 |
| 7,918,237 | B1 | * | 4/2011 | Kuo et al. | 135/65 |
| 2004/0035453 | A1 | | 2/2004 | McGrath | |
| 2006/0011229 | A1 | | 1/2006 | Tseng | |

(Continued)

FOREIGN PATENT DOCUMENTS

WO 02059499 A2 8/2002

*Primary Examiner* — Noah Chandler Hawk
(74) *Attorney, Agent, or Firm* — Adler Pollock & Sheehan P.C.; Daniel J. Holmander, Esq.; George N. Chaclas, Esq.

(57) ABSTRACT

A medical crutch includes a supporting member having an upper portion and a lower portion. The upper portion includes an upper end having an arm support area and a handle area. The lower portion includes an adjustable system and a shock absorbing system. The pneumatic shock absorbing system is configured for removable attachment to an adjustable shaft. The pneumatic shock absorbing system is configured to provide a dampening means. The pneumatic shock absorbing system further includes a shock absorbing coupler to provide removable attachment of the shock absorber unit to the shock absorbing system.

16 Claims, 21 Drawing Sheets

(56) References Cited

U.S. PATENT DOCUMENTS

| | | | | |
|---|---|---|---|---|
| 2007/0089770 | A1 | 4/2007 | Park | |
| 2009/0114257 | A1 | 5/2009 | Sutton | |
| 2009/0250088 | A1 | 10/2009 | Gibbons et al. | |
| 2010/0200031 | A1* | 8/2010 | Vegvary | 135/69 |
| 2010/0307549 | A1 | 12/2010 | Goodwin | |
| 2011/0209733 | A1 | 9/2011 | Basham | |
| 2012/0160286 | A1 | 6/2012 | Ban | |

* cited by examiner

MEDICAL CRUTCH

CROSS REFERENCE TO RELATED APPLICATION

This non-provisional patent application is related to and claims priority from earlier filed, U.S. Provisional Patent Application No. 61/681,689 filed Aug. 10, 2012, all of which is incorporated herein by reference.

BACKGROUND OF THE INVENTION

The present invention relates to medical devices, and more particularly to medical crutches. The medical crutch is used in the medical field, and is traditionally used in the orthopedics department and sold in the category of durable medical equipment or DME. The medical crutch is used to support all or part of a patient's body weight. A medical crutch has been made of wood or metal, and is configured to reach from a patient's underarm to a walking surface.

Referring to FIG. 1 of the prior art, crutches are usually configured to have a fixed-length frame having an arm support for placement under the arm, a a handle that extends horizontally between two support legs to support the weight of a patient, and a fixed boot configured to contact the ground.

Shock absorbing devices including springs have been used with crutches to lessen the impact to a patient as the body weight is transferred to the walking surface. Also, many shock absorbing devices have been located at an upper portion of the crutches. While various configurations have been attempted, there remains a need for a crutch having a pneumatic shock device located at a lower portion of the crutch.

BRIEF SUMMARY OF THE INVENTION

The present invention preserves the advantages of existing medical crutches while providing new advantages not found in currently available medical crutches and overcoming many disadvantages of such currently available medical crutches.

The crutch comprises a supporting member having an upper portion and a lower portion. The upper portion comprises an upper end having an arm support area and a handle area. The lower portion comprises an adjustable system and shock absorbing system, such as a pneumatic shock absorbing system. The shock absorbing system is configured for removable attachment to the adjustable system. The shock absorbing system is configured to provide a dampening means. The shock absorbing system further comprises a shock absorbing coupler to provide removable attachment of the shock absorber unit to the shock absorbing system.

BRIEF DESCRIPTION OF THE DRAWINGS

The novel features which are characteristic of the crutches are set forth in the appended claims. However, the crutch, together with further embodiments and attendant advantages, will be best understood by reference to the following detailed description taken in connection with the accompanying drawing Figures.

DETAILED DESCRIPTION OF THE PREFERRED EMBODIMENTS

Figure 1:
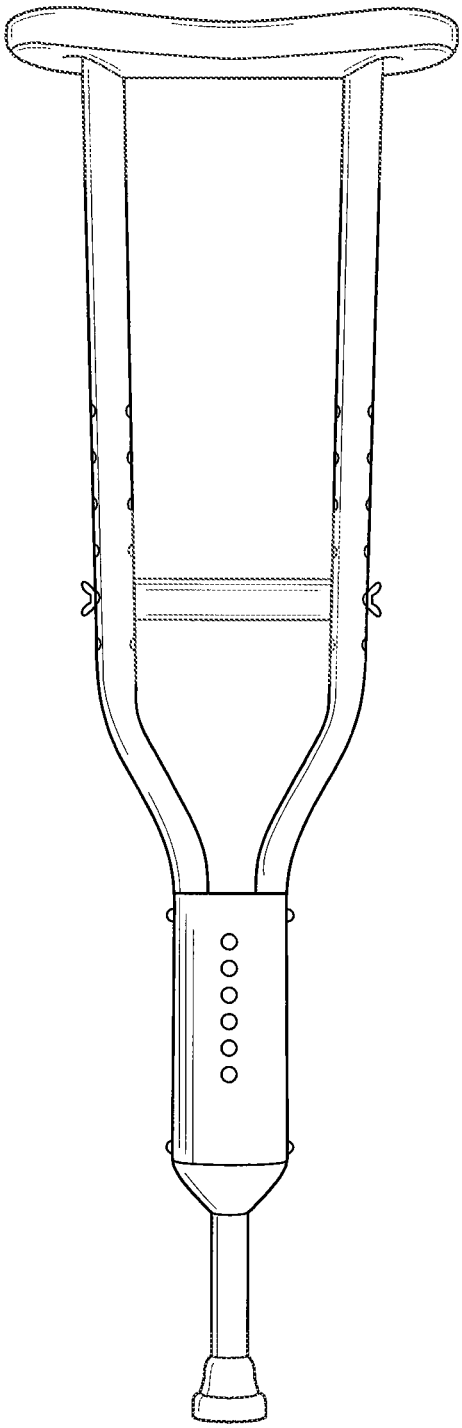
FIG. 1 PRIOR ART
FIG. 1 is a side view of a prior art turn medical crutch.

Referring now generally to FIGS. 2-19, the medical crutches 10A-10C of the instant invention is illustrated. The medical crutches 10A-10C of the present invention solves many problems and has several advantages to the prior art medical or standard crutch. First, the ease of use and comfort are far more advantageous than any standard crutch (FIG. 1). The crutches 10A-C of the present invention comprise a shock absorber system 20A-C and adjustable system 30A-C which assists a user's mobility and makes it a smoother step for them. The shock absorber system 20A-C and the adjustable system 30A-C allows for less stress and pain on the shoulders, armpits wrists and all parts of the body involved in the use of the crutches 10A-C. Also, the shock absorber system 20A-C comprises a dampening shock absorber which relieves pain and aggravation. All of the features above shall be further explained in detail below.

The medical crutch 10A-C comprises a supporting member 12A-C having an upper portion and a lower portion. In one embodiment, the medical crutch is made of anodized aluminum. Of course, materials other than anodized aluminum may be used to construct the medical crutch. The upper portion comprises an upper end having an arm support area 14A-C and a handle support area 16A-C. Of course, the medical crutch may have additional components or features that are known in the prior art or a standard crutch.

The lower portion of the crutch is different from the standard crutch in that it comprises an adjustable system and shock absorbing system. The location of the shock absorbing unit or shock absorbing system in the lower portion of the crutch is significant and critical to optimal operation of the crutch for the following reasons. First, the user benefits from this location in the lower portion due to the shock absorber system or unit being the first thing that comes into contact with the walking surface. By having the shock absorber unit or system located in the lower portion, the weight of the user and their entire body will compress downward more evenly providing greater comfort. Second, a spacing between an armpit pad or arm area pad is most desirable for the comfort of the user—this is proper crutch usage. If the shock absorber unit or system is in lower portion of the crutch as opposed to other areas, then the applied downward force will not cause that upper region to make contact with the armpit causing contact of the armpit pad to armpit.

Figure 3:
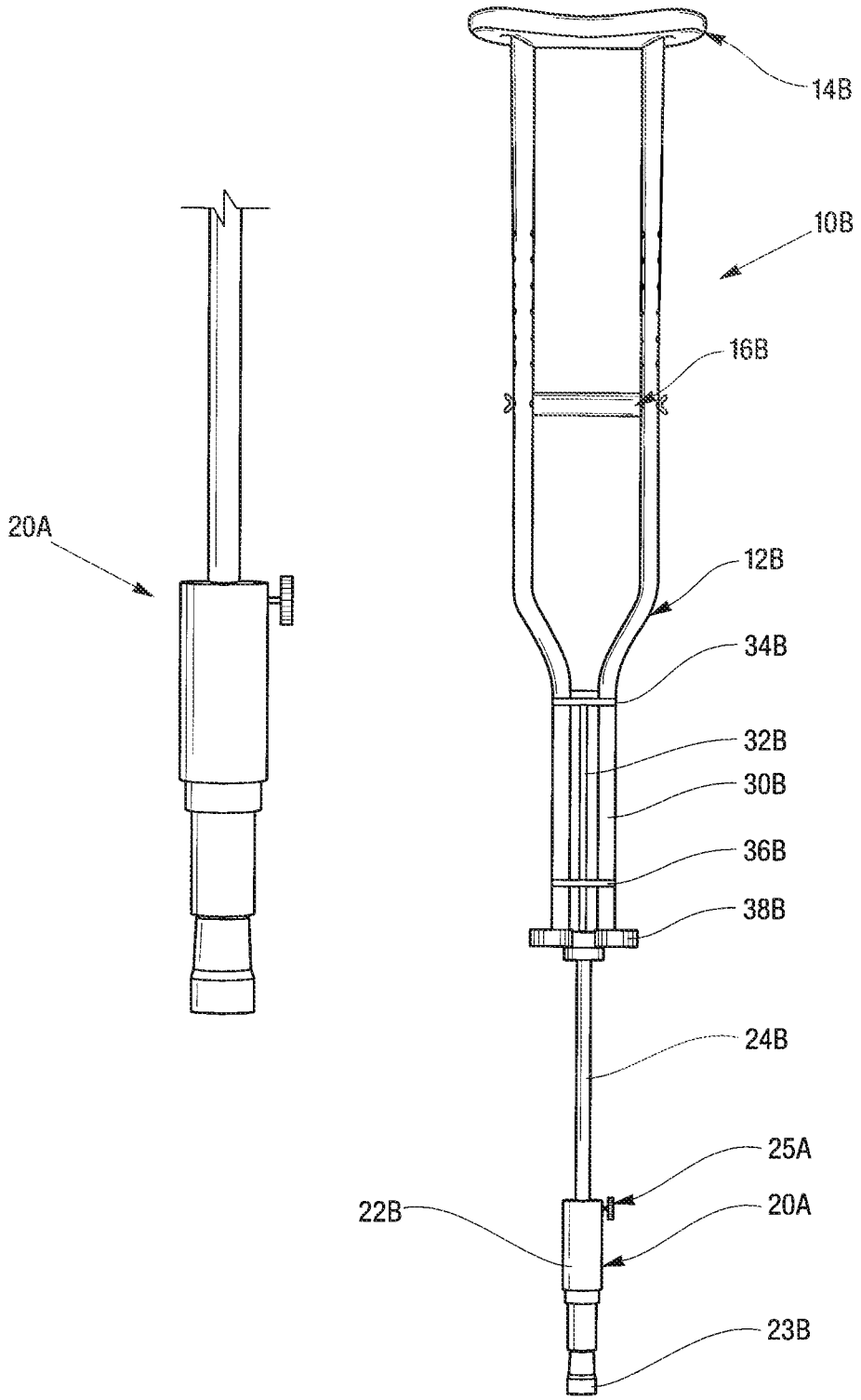
FIG. 3 is a side view of another embodiment of the medical crutch of the present invention.
Figure 4:
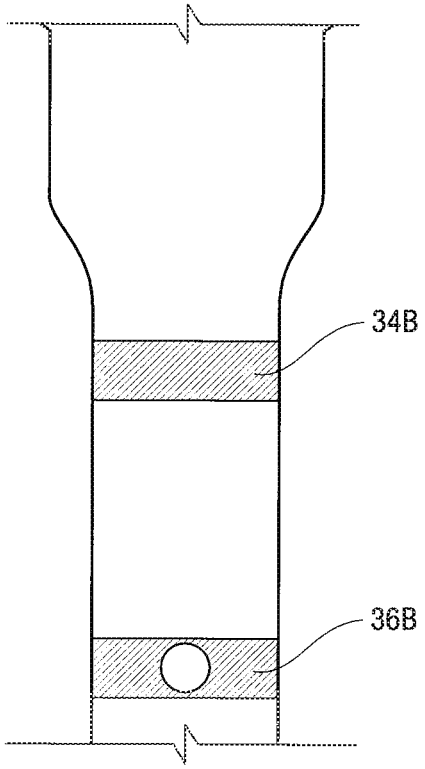
FIG. 4 is a partial view of plates used in medical crutch of FIG. 3.

In one embodiment, referring to FIG. 3, the adjustable system 30B comprises one or more of the following components: an adjustable shaft 24B, threaded rod 32B, one or more plates 34B, 36B, a crutch coupler 38B, and other related components if desired or necessary. In this embodiment, there is a fixed nut 27 at the top of the adjustable shaft 24B which will feed onto the threaded rod 32B extending through the crutch 10B. Referring to FIG. 4, this threaded rod 32B will be fixed at the top onto the plate 34B that reaches across the two support legs of the crutch and extends downward ending part way through the "T" shaped coupler that the two support legs are mounted into. This will allow for no possible error of a user accidently using the crutch without proper support of the shock absorbers upper removable shaft to be securely inside the "T" shaped coupler. Once the shock absorber shaft 23C has been successfully threaded the user can continue to twist the shock and shaft to adjust to desired position. The bottom plate 36B (again that extends across the two support cross members) has an opening just big enough to allow the diameter of the shock shaft to pass through. At this time once the adjusting has reached a max position the shock shaft will come in contact with the top plate and the bottom of the T shaped coupler will be in contact the top of the shock absorber.

In another embodiment, referring to FIG. 5-19, the adjustable system comprises one or more of the following components: an adjustable or primary shaft 24C with a threaded disc 31C at a top end, one or more adjustable sleeves 35C, 37C, a crutch coupler 38C, and other related components if desired or necessary. In this embodiment, there is another fixed end, such as a threaded disc, at the top of the primary or adjustable shaft which will engage the adjustment sleeves positioned over the support legs or shafts of the crutch. Once the shock absorber shaft 23C has been successfully threaded the user can continue to twist the shock 22C and shaft to adjust to desired position. The crutch coupler 38C has an opening large enough to allow the diameter of the shock shaft to pass through. In operation, the threaded disc 31C engages the adjustment sleeves 35C, 37C upwardly and downwardly along a vertical axis. When the threaded disc 31C, or disc, reaches the crutch coupler 38C, it is located in a maximum extended position. When the threaded disc 31C, or disc engage a top end or portion of the adjustment sleeves 35C, 37C, it is located in a minimum extended position.

Figure 2:
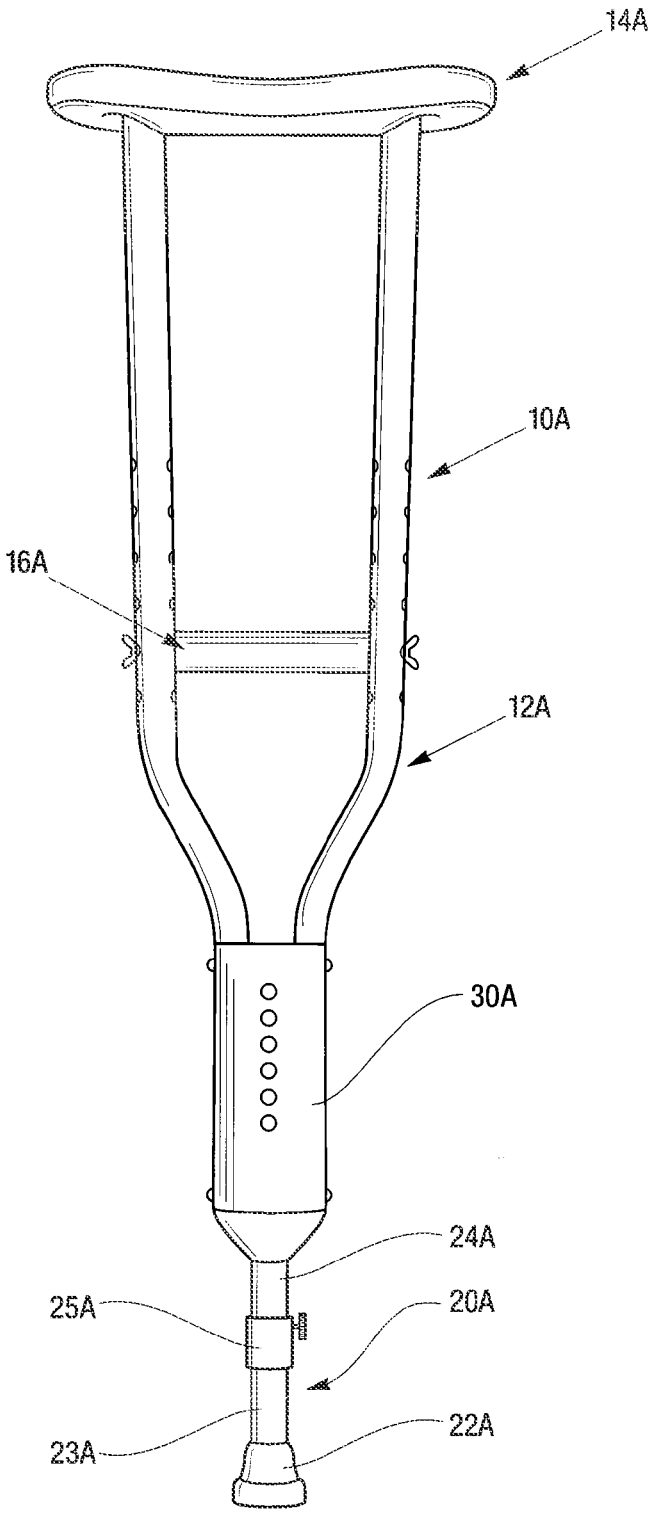
FIG. 2 is a side view of an embodiment of the medical crutch of the present invention.

In one embodiment, referring to FIG. 2, the shock absorber system 20A comprises one or more of the following components: a shock absorber unit 22A, a shock shaft 23A, and a primary or adjustable shaft 24A, an absorber coupler 25A or mechanism, and other related components if desired or necessary. Due to the added shock absorber system 20A, it assists the user's mobility more so than a typical shock and also results in smoother step for them. The smoother step also allows for negative energy to be taken away and positive kinetic energy to be given back to the user.

In one embodiment, referring to FIG. 3, the shock absorber system 20B comprises one or more of the following components: a shock absorber unit 22B, a shock shaft 23B, a primary or adjustable shaft 24B, an absorber coupler 25B or mechanism, and other related components if desired or necessary.

Figure 5:
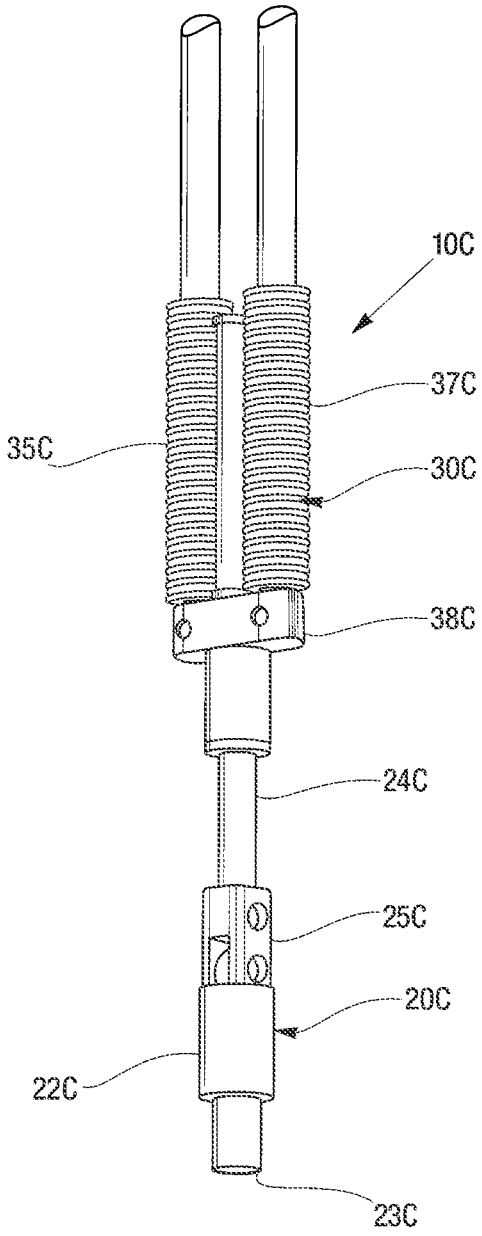
FIG. 5 is an isometric view of another embodiment of the medical crutch of the present invention.
Figure 6:
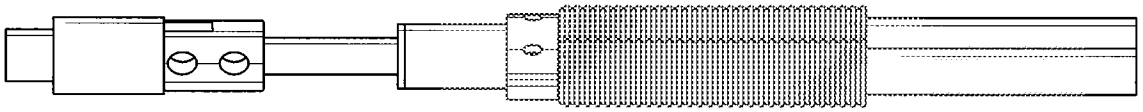
FIG. 6 is a front view of the medical crutch of FIG. 5.
Figure 7:
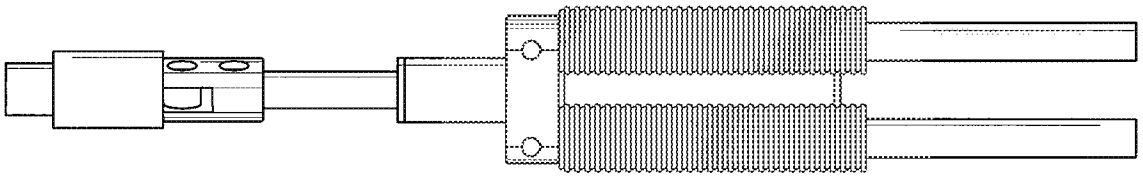
FIG. 7 is a side view of the medical crutch of FIG. 5.
Figure 8:
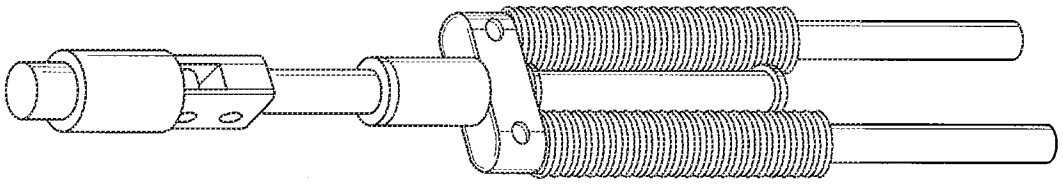
FIG. 8 is a perspective view of the medical crutch of FIG. 5.
Figure 9:
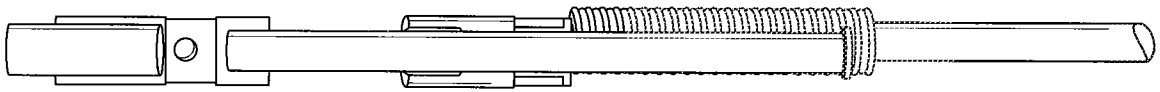
FIG. 9 is a sectional view of the medical crutch of FIG. 5.
Figure 10A:
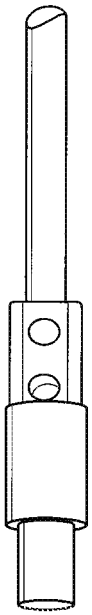
FIG. 10 is a sectional view of a shock absorbing system of FIG. 5.
Figure 10B:
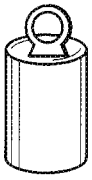
Figure 11:
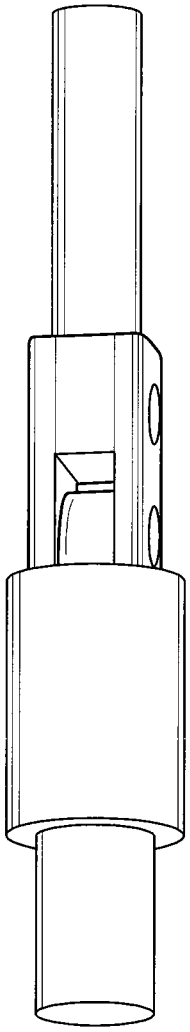
FIG. 11 is another sectional view of a shock absorbing system of FIG. 5.
Figure 12:
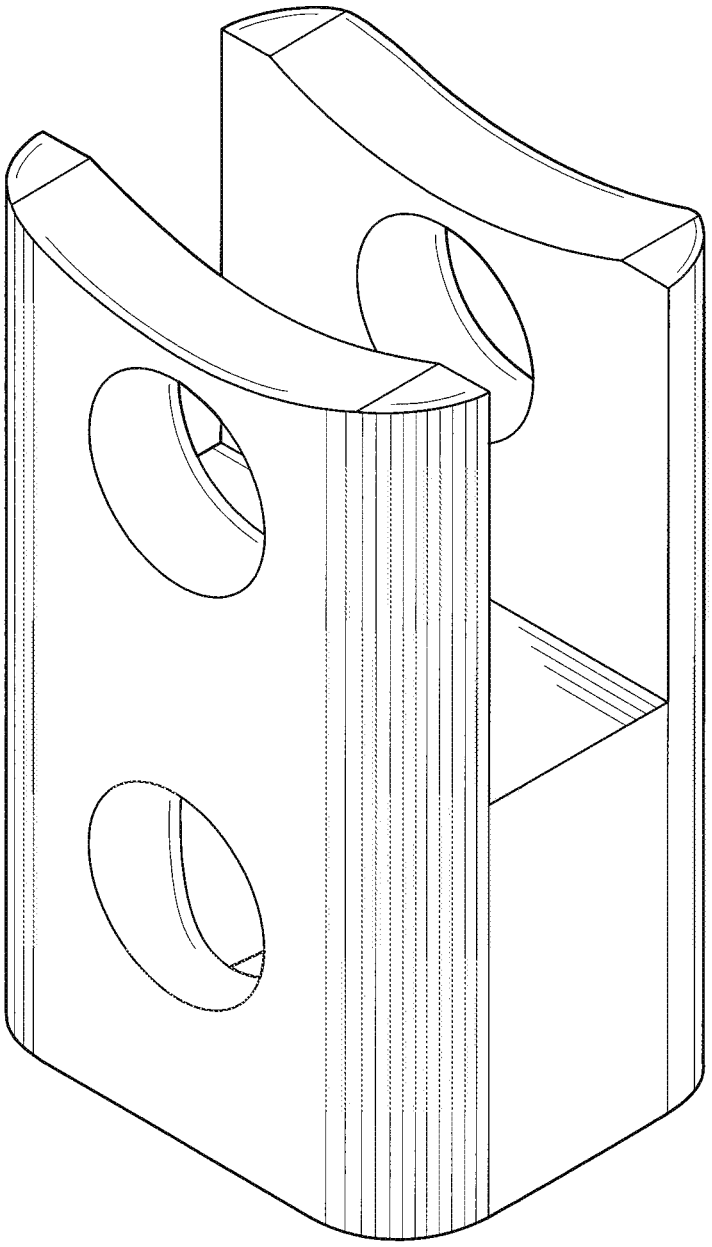
FIGS. 12-15 are a multitude of views of the shock absorbing coupler of FIG. 5.
Figure 13:
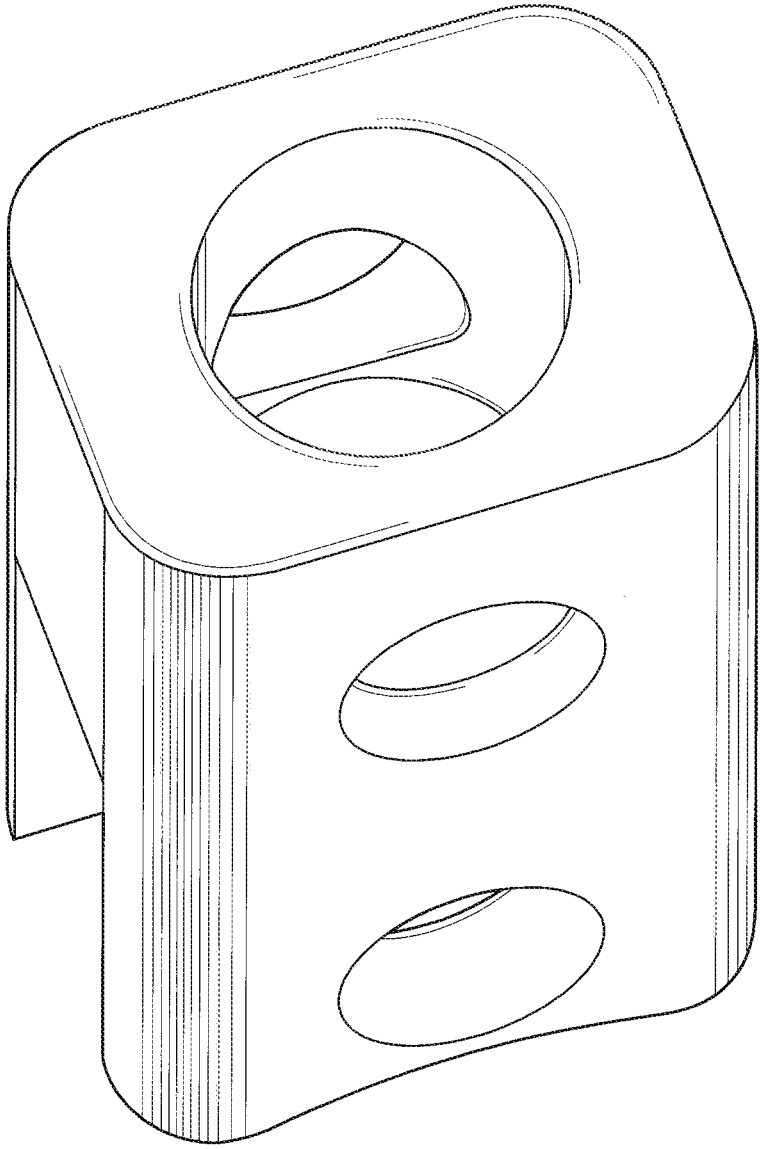
Figure 14:
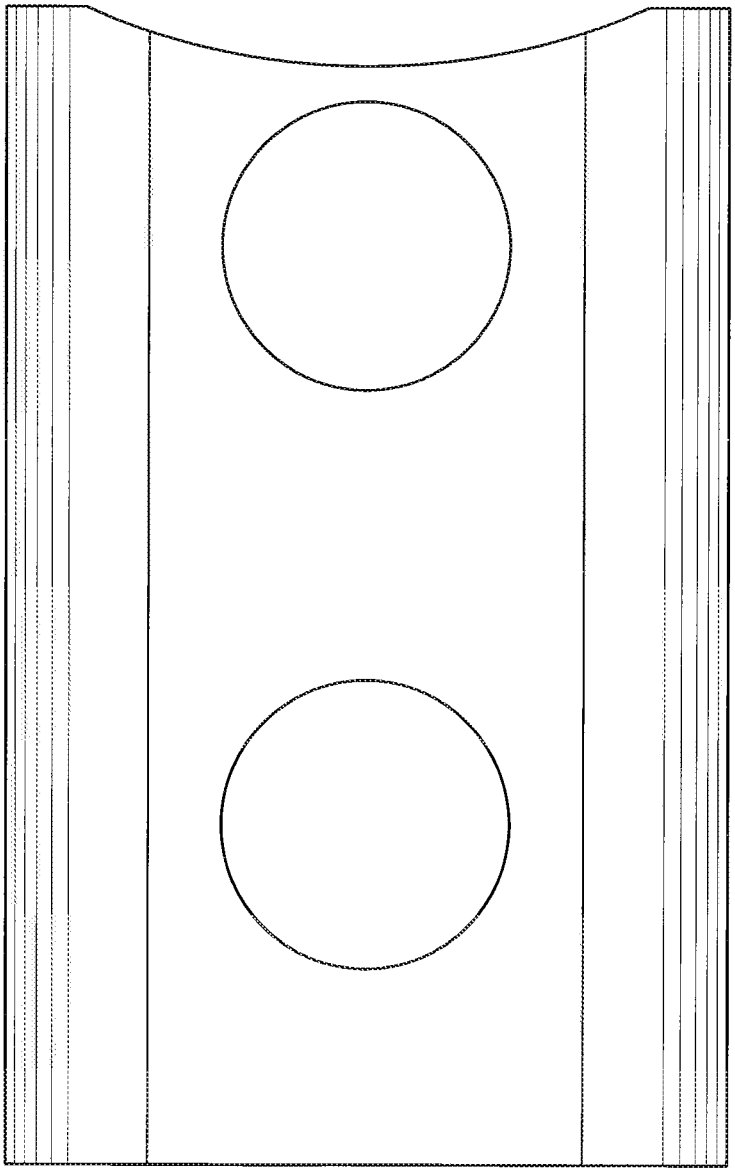
Figure 15:
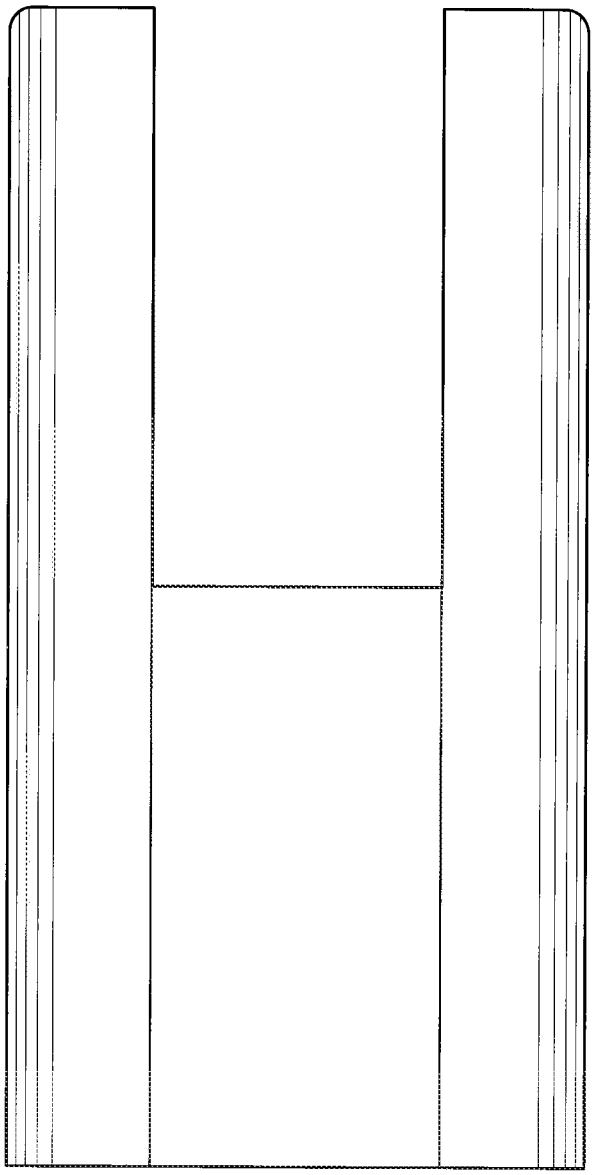
Figure 16:
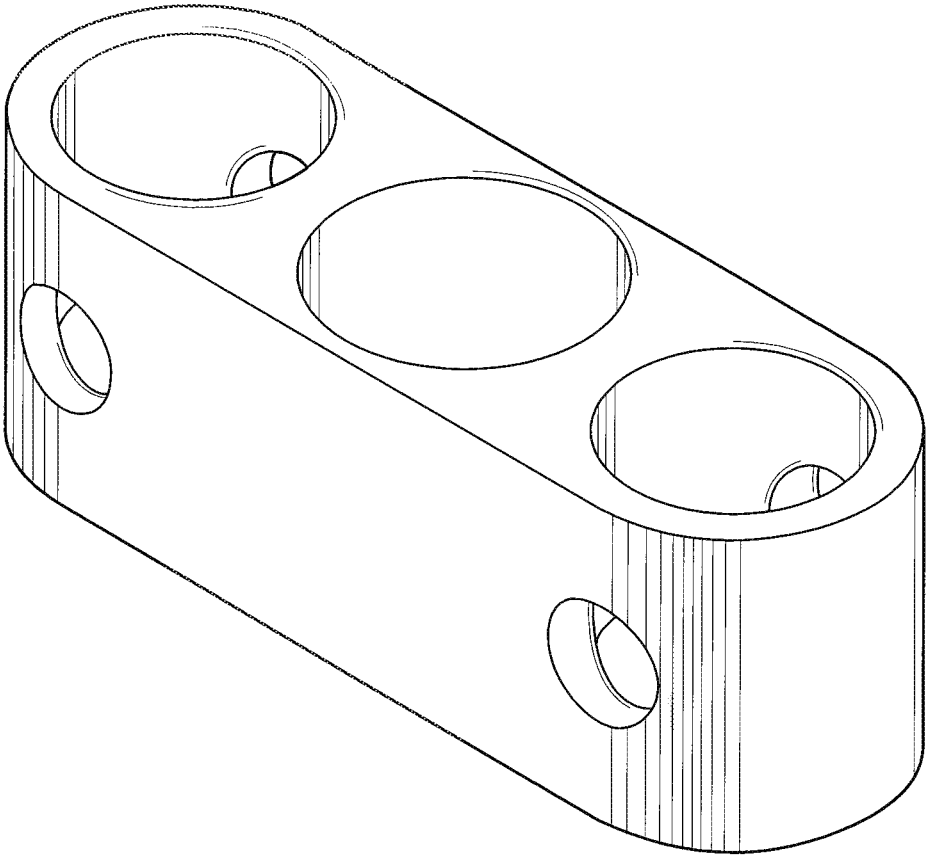
FIGS. 16-19 are a multitude of views of the crutch coupler of FIG. 5.
Figure 17:
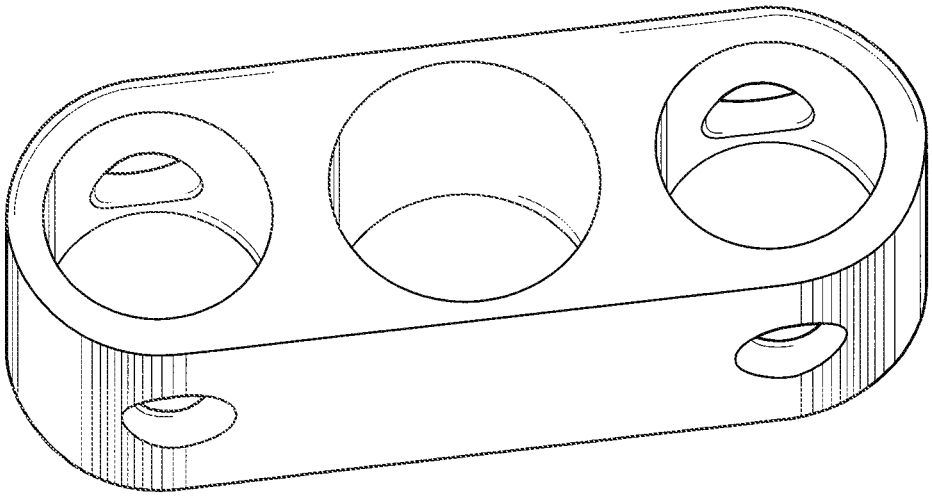
Figure 18:
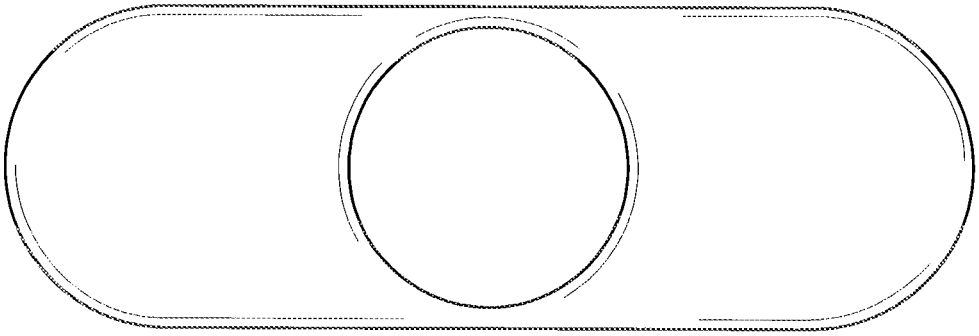
Figure 19:
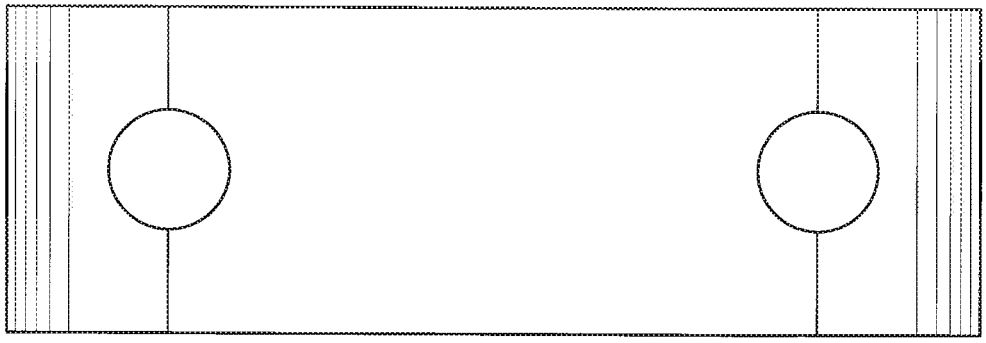
Figure 20:
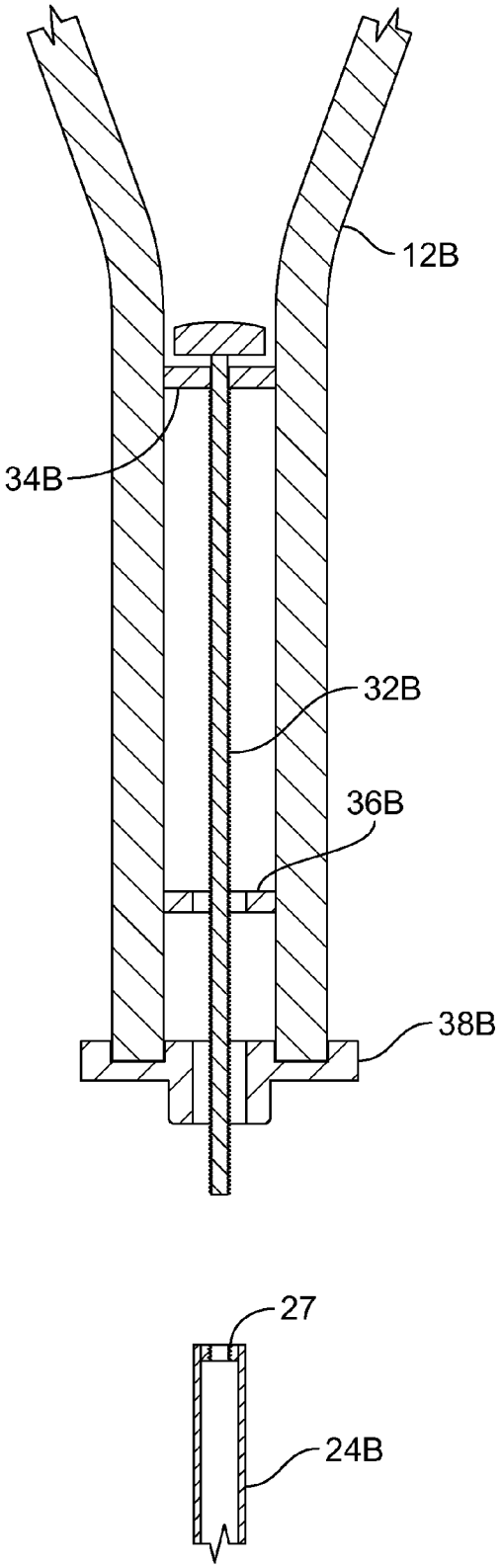
FIG. 20 is an embodiment of a cross section of the medical crutch of the present invention shown in FIG. 3.
Figure 21:
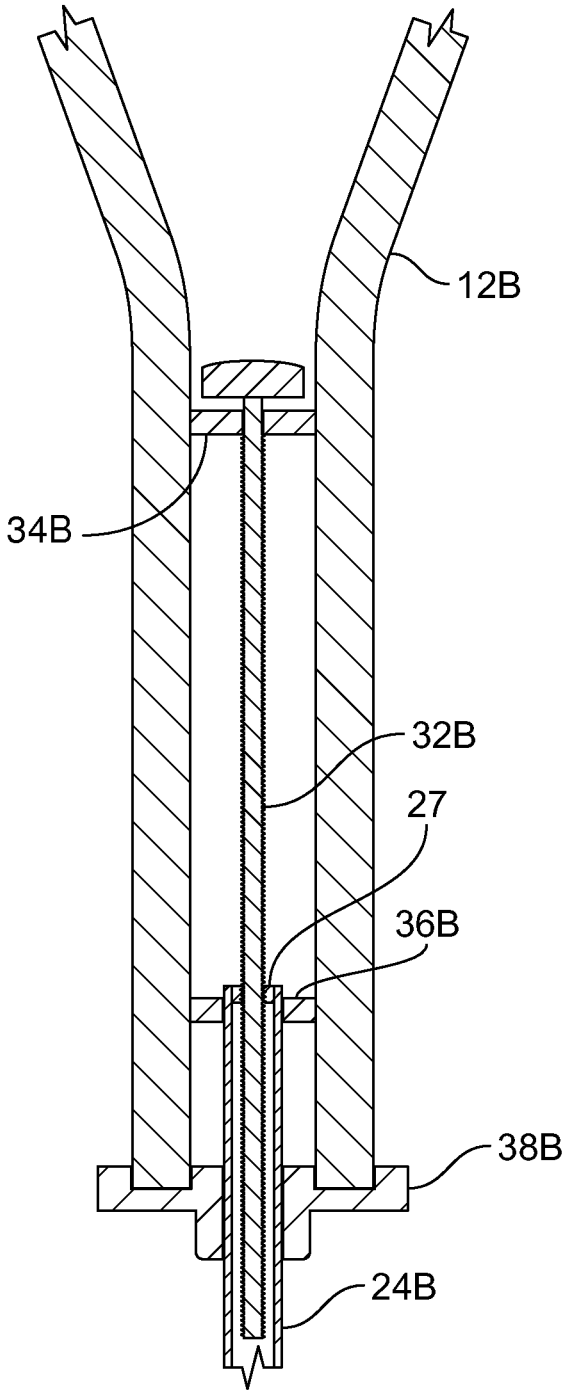
FIG. 21 is the cross section of FIG. 20 with the shaft and threaded rod in an assembled configuration.

In another embodiment, referring to FIG. 5-19, the shock absorber system 20C comprises one or more of the following components: a shock absorber unit 22C, a shock shaft 23C, a primary or adjustable shaft 24C, an absorber coupler 25C, and other related components if desired or necessary. The shock absorbing system 20C may also include an outer casing for the shock absorber unit, one or more bolts or other hardware for connecting the absorber coupler to the absorber unit and the primary or adjustable shaft. The system may further include flanged bushings along the primary shaft or adjustable shaft near the crutch coupler or the support shaft. It should be appreciated that FIG. 5 shows a lower portion of the crutch and the upper portion may be similar to standard crutches.

The shock absorbing system further comprises a shock absorbing coupler 25C to provide removable attachment of the shock absorber unit to the shock absorbing system. Also, the shock absorbing system is configured for removable attachment to the adjustable shaft or adjustable system. The shock absorber unit may have an adjustable or primary shaft, possibly made of aluminum or other materials, mounted onto the top portion of the absorber unit or shock absorber system. The adjustable or primary shaft is removable from the shock absorber unit in the occasion the shock absorber needs to be removed from the crutch and still have the crutch in operation if need be. Referring to FIG. 3, in one embodiment, the removal may be done by a threaded bolt with male end fixed on the shock and a female nut fixed inside the bottom of the shaft. This will allow the shock absorber to come off and the removable rubber boot or other attachment to be placed on the bottom of the shaft.

The shock absorber unit, in one embodiment, may include a pneumatic shock absorber unit. The shock absorber unit may in one embodiment be an air over oil shock absorber unit. In operation, the air over oil shock absorber unit may operate at specific air pressure and it includes an oil orifice inside that helps to maintain smooth movement of a piston inside of the shock absorber unit. In one embodiment, the shock is approximately 6" in total height and consists of a shaft as well as an outer casing. The outer casing is the air chamber and the inside of the shaft is an oil orifice.

This unique crutch will absorb unwanted negative energy for the user and in return releasing positive energy. This is done through kinetic energy. The velocity rate at which the user's body weight propels in a downward direction is slowed down dramatically to make for a much smoother step, creating less stress on the shoulders, hands, and other joints that are used during the operation.

All moving objects possess kinetic energy. The amount of energy is dependent upon weight and velocity Shock absorber or shock absorber units provide controlled, predictable deceleration. The shock absorber units work by converting kinetic energy to thermal energy. More specifically, motion applied to the piston of a hydraulic shock absorber pressurizes the fluid and forces it to flow through restricting orifices, causing the fluid to heat rapidly. The thermal energy is then transferred to the cylinder body and harmlessly dissipated to the atmosphere. At the instant in time when the shock is to come in contact with the ground there is an initial static force that will be greater than the following few seconds of the shock operation and that is what the purpose of the shock absorber is for to absorb that static force and smooth it out.

The shock absorbing system or unit is configured to provide a dampening means. In addition, the pneumatic shock absorber is adjustable by having a dampening pneumatic shock absorber. The pneumatic shock absorber has adjustable rebound to control the amount of time it takes the shock's plunger to return to the starting position based on the speed of the user's steps. It also has an adjustable compression force which is a dampening force based on how many PSI of air is put into the shock which is a direct result of the users weight. This means that there is a very large range of weight allowed for adjusting this crutch. Depending on how heavy the user is they can put as much air as they want into the shock to adjust for how their body weight will affect the compression distance and stiffness of the compression.

The amount of high pressure air the user inputs into the shock absorber unit with a safe and user friendly air pump will determine the compression dampening. This is how stiff (slow or fast) the shaft will compress downward as the user applies their weight on the shock. The adjustment is allowed of the shock absorber unit for all weights to match the body weight of any user weather it's a small 100 lb individual or a 300 lb athlete. The dampening of compression can also be altered for not only ones weight but depending on the terrain one is walking through. A heavier individual when walking through areas with a softer terrain can change the compression dampening to a lower psi by letting out some of the air allowing them to apply less force to the shock to maintain an equal amount of compression on the shock as if they were on firm ground. In other words if the they were on softer terrain and there were potentials for sinking into the ground terrain. This facilitates and maintains an even amount of shock stroke length compression. The stroke length is the distance the shock shaft compresses.

There is also a rebound compression which is adjusted by a small tuning knob. The adjusting or tuning knob that will adjust the rebound speed of the damper shaft depending to accurately return to starting position before the user's next step is taken. This will control the speed at which the shaft will return to normal or starting position again. This will allow users comfortably walk on these crutches at their own pace. The shock absorber unit rebound should not be too slow so that the shock shaft has not reached the starting position before the user is ready to take another step and apply the crutch to the ground. Some people walk faster than others and some have a bigger stride and shorter stride so the adjustability of the shock absorber unit is an advantage.

In an alternative embodiment, the above embodiments may include a standard crutch that is retrofitted with the shock absorbing system, the adjustable system, or both. Also, in another alternative embodiment, the shock absorbing system may include a shock absorber unit known in the art, such as SRAM® Monarch RT3 or similar, or other types of shock absorbers other than pneumatic, such as gas assisted shocks, hydraulic shocks, or others.

It would be appreciated by those skilled in the art that various changes and modifications can be made to the illustrated embodiments without departing from the spirit of the present invention. All such modifications and changes are intended to be covered by the appended claims.

What is claimed is:

1. A medical crutch, comprising:

a supporting member comprising an upper portion, a lower portion, and an adjustable system;

the upper portion comprising an upper end having an arm support area and a handle area;

the lower portion comprising a shock absorbing system;

the adjustable system being connected to the shock absorbing system, the adjustable system further comprising:

a top plate secured to a pair of support legs of the upper portion;

an externally threaded rod fixed to the top plate and extending downward from the top plate between the pair of support legs;

a shaft secured to the lower portion;

a nut at a top end of the shaft, the nut being fed onto the threaded rod for adjusting the height of the medical crutch;

a bottom plate secured to the upper portion, the bottom plate having an opening that has an opening diameter that allows the shaft of the lower portion to pass therethrough, whereby the shaft extends through the opening of the bottom plate;

a crutch coupler that secures the support legs to each other at a lower end of each support leg;

wherein the threaded rod is coupled to the nut of the shaft; and wherein the threaded rod is longitudinally fixed so the nut of the shaft screws onto the rod to adjust the height of the shock absorbing system between a minimum overall length position where a top of the shaft contacts the top plate and a plurality of different operable positions by rotating the shaft wherein the top of the shaft is above the bottom plate.

2. The medical crutch of claim 1, wherein the shock absorbing system is a pneumatic shock absorbing system.

3. The medical crutch of claim 1, wherein the shock absorbing system is configured to provide a dampening means.

4. The medical crutch of claim 1, wherein the shock absorbing system is configured for removable attachment to the shaft.

5. The medical crutch of claim 4, wherein the shock absorbing system comprises a shock absorbing coupler to provide removable attachment of the shock absorber unit to the shock absorbing system.

6. The medical crutch of claim 1, wherein the crutch coupler has a central aperture that the shaft extends through.

7. The medical crutch of claim 1, wherein the top of the shaft is above the crutch coupler.

8. The medical crutch of claim 1, wherein the crutch coupler is T-shaped with a wide upper portion that couples to the support legs.

9. The medical crutch of claim 1, further comprising a coupling mechanism for selectively securing to the shaft, wherein the coupling mechanism couples the crutch coupler to the shaft.

10. The medical crutch of claim 1, further comprising a fixed nut on the shaft, wherein a position of the fixed nut on the shaft determines a maximum overall length position.

11. The medical crutch of claim 10, wherein at the maximum overall length position, the fixed nut aligns with the bottom plate.

12. The medical crutch of claim 10, wherein at the maximum overall length position, the fixed nut aligns with the crutch coupler.

13. The medical crutch of claim 1, wherein the externally threaded rod extends through the bottom plate.

14. The medical crutch of claim 13, wherein the externally threaded rod extends through the crutch coupler.

15. A medical crutch, comprising:

a supporting member comprising an upper portion and a lower portion;

the upper portion comprising an upper end having an arm support area and a handle area;

the lower portion comprising:

an adjustable system;

an air over oil shock absorbing system configured for removable attachment to the adjustable system, the shock absorbing system configured to provide a dampening means, the shock absorbing system further comprises a shock absorbing coupler to provide removable attachment of the shock absorber unit to the shock absorbing system;

the adjustable system comprising:

a top plate secured to a pair of support legs of the upper portion, and an externally threaded rod fixed to the top plate and extending downward from the top plate between the pair of support legs;

a nut at a top end of a shaft of the lower portion, the nut being configured to be fed onto the threaded rod for adjusting a height of the medical crutch;

a bottom plate secured to the upper portion, the bottom plate having an opening just big enough to allow the shaft of the lower portion to pass therethrough;

a crutch coupler that secures the support legs to each other at a lower end of each support leg;

wherein the threaded rod is configured for receiving the nut of the shaft; and wherein the threaded rod is longitudinally fixed so the nut of the shaft screws onto the rod to adjust the height of the shock absorbing system between a minimum overall length position where a top of the shaft contacts the top plate and a plurality of different operable positions by rotating the shaft so that the top of the shaft moves away from the top plate to a new fixed location.

16. The medical crutch of claim 15, wherein a position of the top of the shaft relative to the bottom plate determines a maximum overall length position.

* * * * *